US010035178B2

(12) United States Patent
Elam, Sr.

(10) Patent No.: US 10,035,178 B2
(45) Date of Patent: Jul. 31, 2018

(54) HAND-HELD DRAIN OPENING APPARATUS

(71) Applicant: Adonis Elam, Sr., Merrillville, IN (US)

(72) Inventor: Adonis Elam, Sr., Merrillville, IN (US)

( * ) Notice: Subject to any disclaimer, the term of this patent is extended or adjusted under 35 U.S.C. 154(b) by 0 days.

(21) Appl. No.: 15/627,761

(22) Filed: Jun. 20, 2017

(65) Prior Publication Data

US 2017/0361362 A1 Dec. 21, 2017

Related U.S. Application Data

(60) Provisional application No. 62/352,422, filed on Jun. 20, 2016.

(51) Int. Cl.

| | |
|---|---|
| ***B08B 9/035*** | (2006.01) |
| ***A47L 7/00*** | (2006.01) |
| ***A47L 5/24*** | (2006.01) |
| ***E03C 1/30*** | (2006.01) |

(52) U.S. Cl.

CPC ..... *B08B 9/035* (2013.01); *A47L 5/24* (2013.01); *A47L 7/0004* (2013.01); *A47L 7/009* (2013.01); *A47L 7/0009* (2013.01); *A47L 7/0023* (2013.01); *E03C 1/30* (2013.01)

(58) Field of Classification Search

CPC ..... B08B 9/035; A47L 7/0004; A47L 7/0009; A47L 7/0023; A47L 7/009; A47L 5/24; E03C 1/30

USPC ..... 4/255.01, 255.03, 255.06, 255.12

See application file for complete search history.

(56) References Cited

U.S. PATENT DOCUMENTS

| | | | | |
|---|---|---|---|---|
| 1,236,053 | A * | 8/1917 | Hori | B65D 90/54 52/196 |
| 6,009,596 | A * | 1/2000 | Buss | A47L 7/0028 15/352 |
| 2013/0318741 | A1 * | 12/2013 | Moyher, Jr. | A47L 7/0023 15/327.1 |

* cited by examiner

*Primary Examiner* — Tuan N Nguyen
(74) *Attorney, Agent, or Firm* — RG Patent Consulting, LLC; Rachel Gilboy

(57) ABSTRACT

A portable and compact, hand-held electrically powered vacuum tool, designed expressly for suctioning clogs from the drains and traps of sinks and bathtubs to pull clogs out of drains and traps thereby clearing the clog without use of chemicals and recover items such as rings and toothpaste-tube caps that have gone down the drain.

8 Claims, 3 Drawing Sheets

HAND-HELD DRAIN OPENING APPARATUS

CROSS-REFERENCE TO RELATED APPLICATION

The present application is related to and claims priority from prior provisional application Ser. No. 62/352,422, filed Jun. 20, 2016, which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of drain blockage removal devices and more specifically relates to a portable and compact, hand-held electrically powered vacuum tool, designed expressly for suctioning clogs from the drains and traps of sinks and bathtubs to pull clogs out of drains and traps thereby clearing the clog without the use of chemicals. The present invention will also recover items such as rings and toothpaste-tube caps that have gone down the drain.

2. Description of the Related Art

Common problems that virtually every household faces at one time or another are a clogged sink, shower, or bathtub drain. Typically, one can address a drain clog with a caustic chemical drain-cleaner—which may not be effective. Alternately, one may attempt to force the clog through the drain with a bathroom plunger—which may work, or may simply lodge the clog more firmly and stubbornly in place.

Various attempts have been made to solve problems found in drain blockage removal devices art. Among these are found in: U.S. Pat. No. 7,000,284 to Ron Sowden; U.S. Pat. No. 8,418,274 to Larry Edward Dodson; and U.S. Publication No. 2013/0000026 to Roberto Gutierrez. This prior art is representative of vacuum type blockage removal systems for various types of drains.

None of the above inventions and patents, taken either singly or in combination, is seen to describe the invention as claimed. Thus, a need exists for a reliable, portable and compact, hand-held electrically powered vacuum tool, designed expressly for suctioning clogs from the drains and traps of sinks and bathtubs to pull clogs out of drains and traps thereby clearing the clog without use of chemicals and recover items such as rings and toothpaste-tube caps that have gone down the drain and to avoid the above-mentioned problems.

BRIEF SUMMARY OF THE INVENTION

In view of the foregoing disadvantages inherent in the known drain blockage removal devices art, the present invention provides a novel hand-held drain opening apparatus. The general purpose of the present invention, which will be described subsequently in greater detail, is to provide a portable and compact, hand-held electrically powered vacuum tool, designed expressly for suctioning clogs from the drains and traps of sinks and bathtubs to pull clogs out of drains and traps thereby clearing the clog without use of chemicals and recover items such as rings and toothpaste-tube caps that have gone down the drain. The features of the invention which are believed to be novel are particularly pointed out and distinctly claimed in the concluding portion of the specification. These and other features, aspects, and advantages of the present invention will become better understood with reference to the following drawings and detailed description.

The present invention holds significant improvements and serves as A hand-held drain opening apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate a preferred embodiment of the hand-held drain opening apparatus, which is constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to drain blockage removal devices and more particularly to a portable and compact, hand-held electrically powered vacuum tool, designed expressly for suctioning clogs from the drains and traps of sinks and bathtubs to pull clogs out of drains and traps thereby clearing the clog without use of chemicals and recover items such as rings and toothpaste-tube caps that have gone down the drain.

Figure 1:
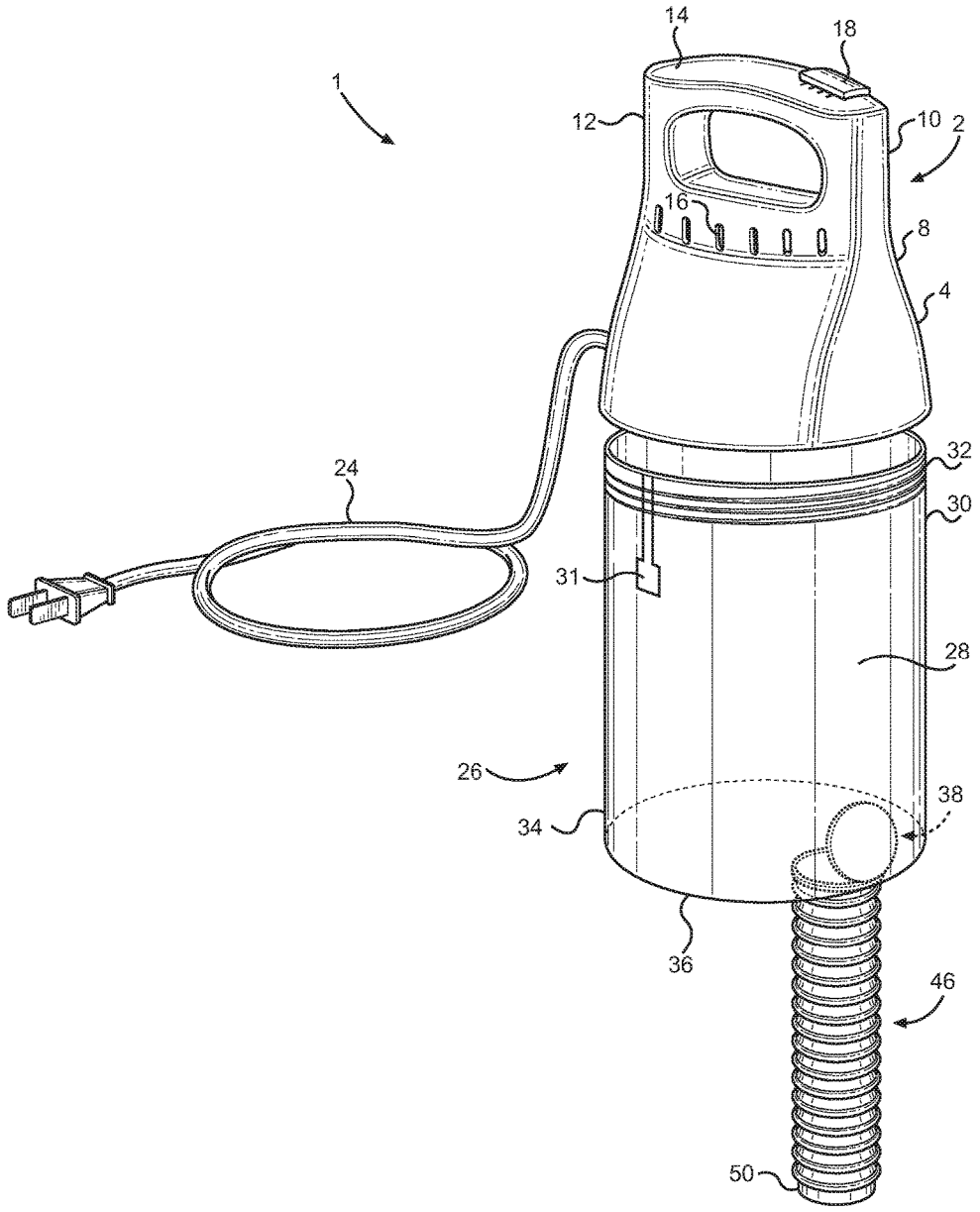
FIG. 1 shows a perspective view illustrating the hand-held drain opening apparatus according to an embodiment of the present invention.
Figure 2:
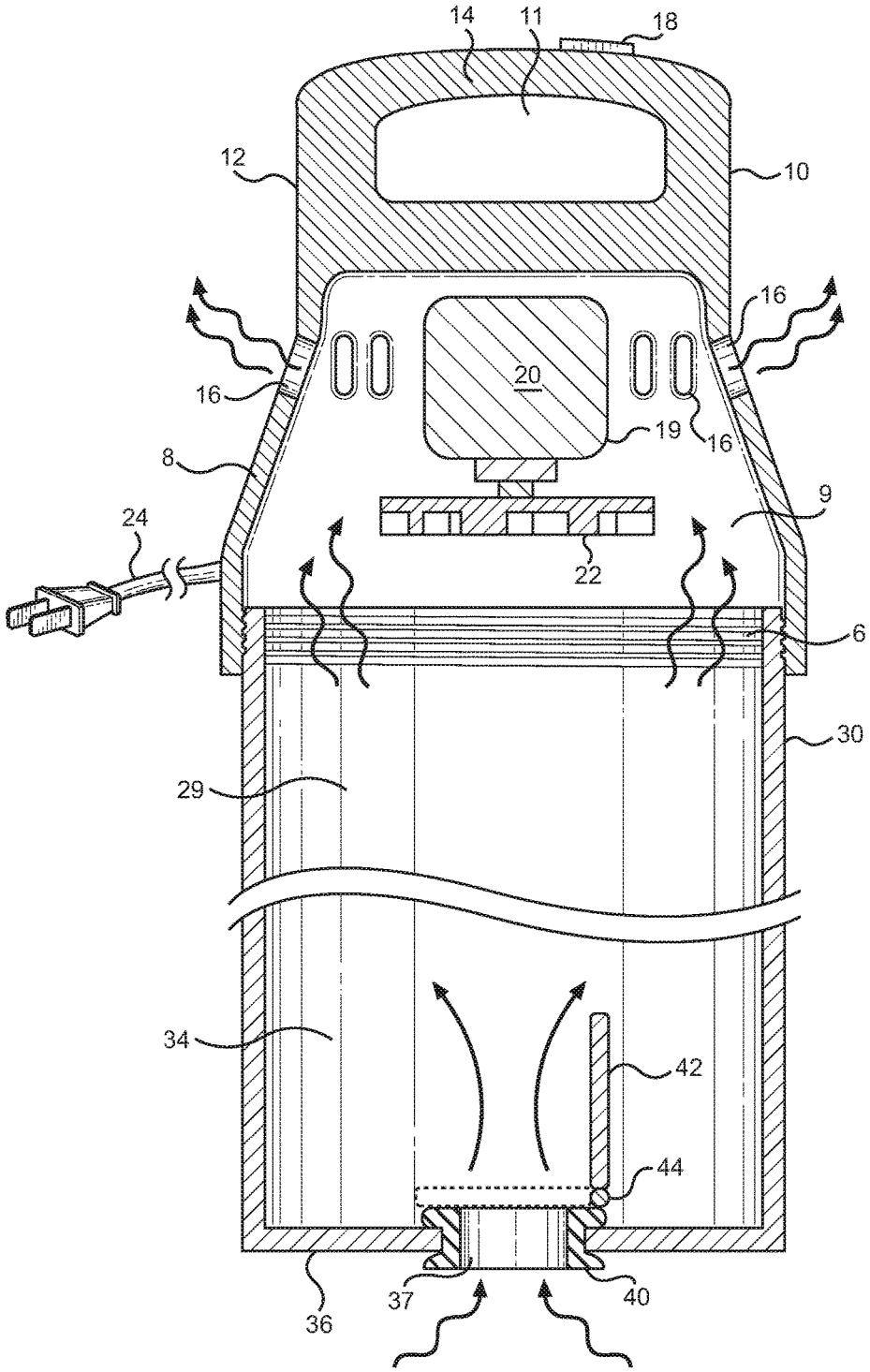
FIG. 2 is a sectional view partially broken away illustrating the upper and lower sections of the hand-held drain opening apparatus according to an embodiment of the present invention.

Referring now to the drawings, as shown in FIGS. 1 and 2, the drain opening apparatus 1 of the present invention is comprised of an upper section 2 releasably secured to a lower section 26 via internal threads 6. The upper section 2 contains the motor-suction fan unit 19, the exhaust air vents 16, the thumb-slide power switch 18, and the three-prong power cord 24 so as to provide the suction power. The lower section 26 is a container that will collect and retain the drain clogs when the motor-suction fan unit 19 is in operation as will be further described The sectional partially broken away view of FIG. 2 illustrates the upper section 2 as comprised of a cylindrical bottom portion 4 having internal threads 6 with an intermediate portion 8 tapering upwardly and inwardly from the bottom portion 4 so as to delineate a hollow interior 9. Disposed on the intermediate portion 8 are a series of slots or apertures forming the exhaust air vents 16. A pair of opposed vertical sections 10, 12 extend from the intermediate portion 8 with each vertical section 10, 12 terminating at a distal end and having an elongated handle portion 14 secured therebetween so as to define a space 11. The handle portion 14 may be contoured for comfort so as to provide for the easy grip and handling of the drain opening apparatus 1 as it is held into a position over a drain opening.

A motor-suction fan unit 19 is disposed within the hollow interior 9 of the upper section 2 and is configured to provide a source of vacuum when powered. The motor-suction fan 19 is comprised of an electric motor 20 suitably mounted within the hollow interior 9 for operation. A suction fan 22 is mounted on the output shaft of the electric motor 20 and is comprised of angled blades such that as they turn air is forced upward and out through the exhaust air vents 16. The movement of the air out through the exhaust air vents 16 provides the necessary pressure drop to create the source of vacuum. In FIG. 2 the arrows depict the path of the flow of air from an inlet port 37 through the suction fan 22 and subsequently out through the exhaust air vents 16 as will be further discussed in detail.

As shown in FIGS. 1 and 2 a 110 volt, three-prong power cord 24 exits from the bottom portion 4 of the upper section 2 and is suitably arranged to provide power to the electric motor 20. The handle portion 14 is provided with a thumb-slide power switch 18 having an Off position configured to turn the motor-suction fan unit 19 off by interrupting the supply of power to the electric motor 20 from the power cord 24. The thumb-slide power switch 18 may be slid to different positions corresponding to Low, Medium, and High to selectively control the speed of the motor-suction fan unit 19 such as for example, by changing the voltage supplied to the electric motor 20. For tougher drain clogs the thumb-slide power switch 18 would be set to High for a greater amount of vacuum. For smaller or lighter drain clogs the thumb-slide power switch 18 would be set to either a Low or Medium setting for a lesser amount of vacuum.

The lower section 26 of the draining opening apparatus 1 is comprised of an elongated cylindrical container 28 having an interior volume 29 defined by an open upper end 30 and a lower end 34 closed by a bottom wall 36. The open upper end 30 has external threads 32 configured to matingly engage with the internal threads 6 of the upper section 2. Thus the lower section 26 may be threaded onto and off of the upper section 2 giving access to the interior volume 29 allowing for the convenient disposal of the drain clog or retrieval of other items that might have gone down the drain but have been pulled out of the drain and into the cylindrical container 28 under the influence of the vacuum provided by the motor-suction fan unit 19.

The bottom wall 36 of the lower section 26 has an inlet port 37 allowing for the ingress of the drain clogs and other items. A rubber gasket 40 is disposed within the inlet port 37 so as to provide a water tight fit as will be further discussed below. Within the interior volume 29 and adjacent to the inlet port 37 is a one-way valve 38. The one-way valve 38 is comprised of a hinged flap 42 pivotally mounted to the rubber gasket 40. The rubber gasket 40 may comprise a hinge portion 44 to which the hinged flap 42 is pivotally mounted such as by a hinge and pintle arrangement. Alternately, the hinge portion 44 may be integral with the hinged flap 42 providing a living hinge arrangement. The one-way valve 38 is arranged for movement between a first position in which the hinged flap 42 covers the inlet port 37 as shown in dashed lines in FIG. 2.

The hinged flap 42 is normally biased in the first position when the motor-suction fan unit 19 is not powered. Thus any drain clog material, liquid, or other items disposed within the cylindrical container 28 will not leak or spill out of the inlet port 37 when the drain opening apparatus 1 has been turned Off. The hinged flap 42 has a second position in which the hinged flap 42 uncovers the inlet port 37 in response to the vacuum provided by the motor-suction fan unit 19 when powered thereby allowing for the ingress of the drain clog and other items into the cylindrical container 28.

Figure 3:
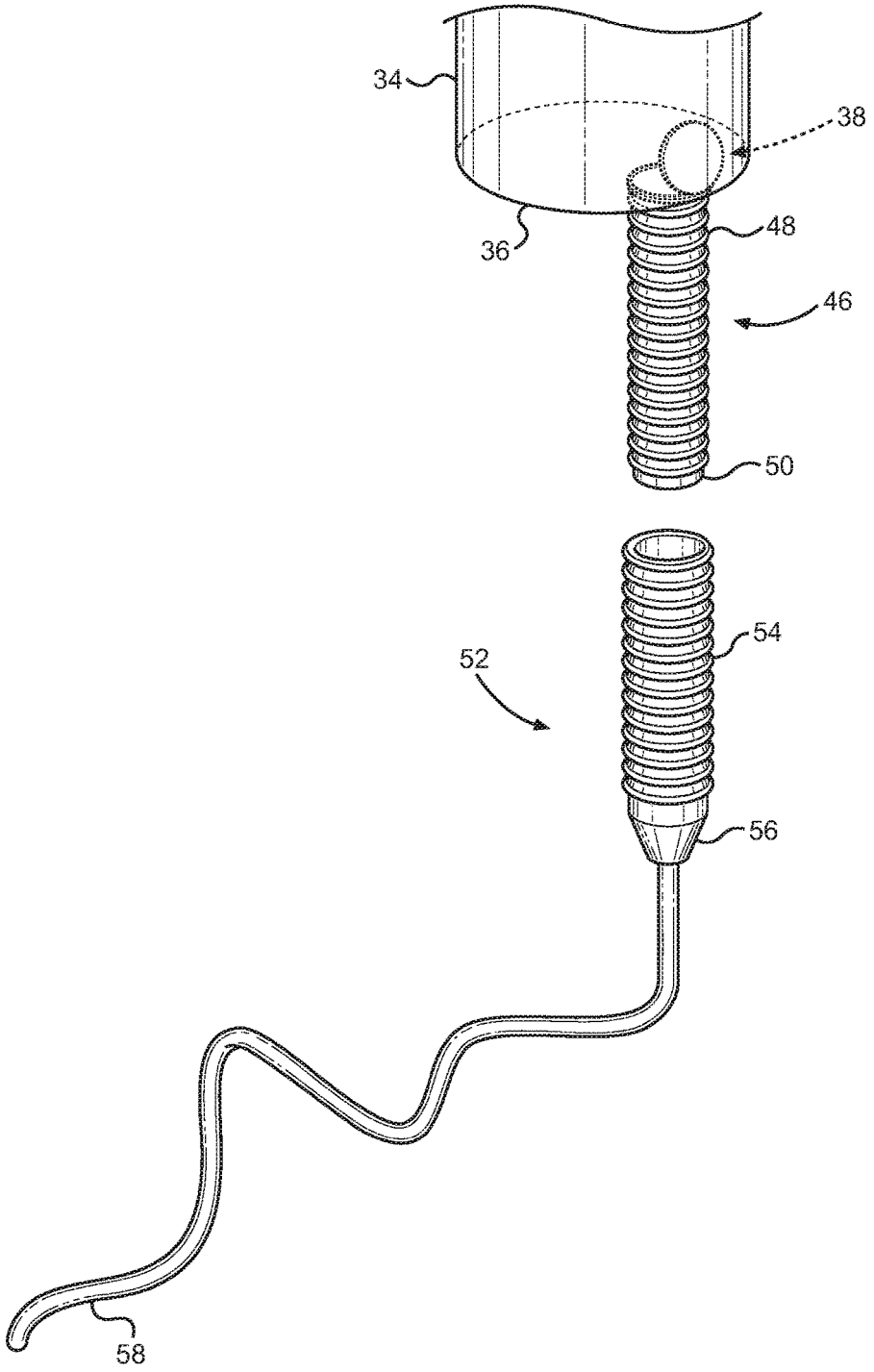
FIG. 3 is a perspective view illustrating the lower section of the hand-held drain opening apparatus along with the vacuum hose and the extension hose according to an embodiment of the present invention.

As illustrated in FIG. 3 the drain opening apparatus 1 includes a flexible vacuum hose 46 having a first end 48 and an opposed second end provided with a rubber sealing ring 50. In a preferred embodiment the vacuum hose 46 may be 2½ to 3 inches in diameter and 8 to 12 inches in length. The first end 48 is fitted to the inlet port 37 via the rubber gasket 40 in a water tight manner. The rubber sealing ring 50 of the second end is configured to be pressed into a position over the drain opening such that when the motor-suction fan unit 19 is powered the vacuum pulls the drain clog and other items through the inlet port 37 and into the cylindrical container 28.

A second, longer extension hose 52 of about 2 to 2½ inches in diameter at its upper end 54 has a tapered section 56 extending to a distal lower end 58 of approximately 1 inch in diameter is also included. The upper end 54 is configured for threading onto the second end of the flexible vacuum hose 46. The extension hose 52 increases suction due to its tapering, smaller opening. For the tough clogs, the extension hose 52 is threaded onto the flexible vacuum hose 46 and the distal lower end 58 is inserted into the drain. With the hoses employed in either fashion, the thumb-slide power switch 18 would be turned to one of the Low, Medium, and High positions, and the clog vacuumed up into the cylindrical container 28 which, once the drain is cleared and the drain opening apparatus 1 turned Off, would be removed from the upper section 2 and emptied into a suitable garbage receptacle.

A "Full" sensor 31 is also included to shut down the drain opening apparatus 1 when the cylindrical container 28 has reached capacity and needs to be emptied. As depicted in FIG. 1 the sensor 31 is provided along the open upper end 30 of the cylindrical container 28 and is configured to interrupt the supply of power to the motor-suction fan unit 19 when the cylindrical container 28 is full.

The drain opening apparatus of the present invention is a novel product offering consumers a practical solution to the aforementioned challenges. The drain opening apparatus is a specially designed hand-held, canister-style vacuum cleaner, measures approximately 15 to 18 inches in length and 5 inches in diameter, and can be fabricated, aside from its interior electrical and mechanical components, in tough and sturdy, scratch, and impact-resistant, injection-molded thermoplastic.

The drain opening apparatus of the present invention offers household consumers, as well as a variety of commercial and institutional entities, a unique and effective means of clearing the clogged drains of sinks, showers, and tubs. The drain opening apparatus suctions clogs out of drains, eliminating the clogs while also retrieving such items as rings, earrings, contact-lenses, and toothpaste caps that have gone down the drain. Easy to use and easily adaptable to variously-sized drains, the drain opening apparatus costs less than a typical plumber's service charge; and unlike chemical drain-clearing products like Drano® or Liquid-Plummer®, the drain opening apparatus would be conveniently on hand when needed, and pose no chemical hazard. Clever in conception, and thoughtful in design, the drain opening apparatus of the present invention should find a wide and enthusiastic reception.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hand-held drain opening apparatus for suctioning drain clogs from drain openings comprising:

an upper section comprising:

a cylindrical bottom portion having internal threads;

an intermediate portion tapering upwardly and inwardly from said bottom portion so as to delineate a hollow interior;

a pair of opposed vertical sections extending from said intermediate portion with each vertical section terminating at a distal end, said opposed vertical sections defining a space therebetween;

an elongated handle portion secured to said distal ends of said pair of opposed vertical sections;

a motor-suction fan unit disposed within said hollow interior and configured to provide a source of vacuum when powered;

a power cord for suppling power to said motor-suction fan unit;

a power switch configured to interrupt the supply of power to said motor-suction fan unit;

a plurality of exhaust air vents for expelling air from said upper section when said motor-suction fan unit is supplied with power;

a lower section comprising:

an elongated cylindrical container having an interior volume defined by an open upper end and a lower end closed by a bottom wall, said open upper end having external threads configured to matingly engage with said internal threads of said upper section, said bottom wall having an inlet port for the ingress of drain clogs;

a one-way valve disposed within said interior volume and comprised of a hinged flap, said hinged flap having a first position in which said flap covers said inlet port, said hinged flap having a second position in which said flap uncovers said inlet port in response to said vacuum provided by said motor-suction fan unit when powered; and a flexible vacuum hose having a first end and an opposed second end, said first end being fitted to said inlet port, said second end being configured to be placed into a position over said drain opening such that when said motor-suction fan unit is powered said vacuum pulls said drain clog into said cylindrical container.

2. The hand-held drain opening apparatus of claim 1, further comprising a gasket disposed within said inlet port, said first end of said vacuum hose being sealingly engaged with said gasket so as to provide a water tight fit with said inlet port.

3. The hand-held drain opening apparatus of claim 2, wherein said hinged flap is pivotally mounted to said gasket for movement between said first position and said second position.

4. The hand-held drain opening apparatus of claim 1, wherein said power switch is configured to adjust a speed of said motor-suction fan unit.

5. The hand-held drain opening apparatus of claim 1, wherein said cylindrical container comprises a sensor configured to interrupt the supply of power to said motor-suction fan unit when said cylindrical container is full.

6. The hand-held drain opening apparatus of claim 1, wherein said second end of said vacuum hose comprises a sealing ring.

7. The hand-held drain opening apparatus of claim 1, further comprising an elongated extension hose having a first end of a first diameter configured to matingly receive said second end of said vacuum hose.

8. The hand-held drain opening apparatus of claim 7, wherein said extension hose has a second end of a second diameter smaller than said first diameter and configured to be inserted into said drain openings.

* * * * *